United States Patent [19]

Nishida et al.

[11] 4,408,242

[45] Oct. 4, 1983

[54] MAGNETIC RECORDING MEMBER FOR AUTOMATIC EMBROIDERING MACHINE

[75] Inventors: Koji Nishida; Taneichi Kawai, both of Anjo, Japan

[73] Assignee: Aisin Seiki Kabushiki Kaisha, Kariva, Japan

[21] Appl. No.: 302,821

[22] Filed: Sep. 16, 1981

[30] Foreign Application Priority Data

Sep. 29, 1980 [JP] Japan ..... 55-135549

[51] Int. Cl.[3] ..... G11B 31/00; G11B 23/16

[52] U.S. Cl. ..... 360/131; 112/121.12; 360/79

[58] Field of Search ..... 360/134, 131, 132, 79; 83/71, 910; 112/121.11, 121.12

[56] References Cited

U.S. PATENT DOCUMENTS 3,294,924 12/1966 Fein ..... 360/79
3,703,041 11/1972 Kohtani ..... 35/35 C
4,145,723 3/1979 Mucha et al. ..... 360/79
4,290,375 9/1981 Tonomura et al. ..... 112/121.12
4,309,950 1/1982 Franklin ..... 112/121.12
4,365,564 12/1982 Sugiyama ..... 112/121.12

OTHER PUBLICATIONS

Meistergram, Meistermatic 600, Sep. 1978.

*Primary Examiner*—Alfred H. Eddleman
*Attorney, Agent, or Firm*—Finnegan, Henderson, Farabow, Garrett & Dunner

[57] ABSTRACT

A magnetically recorded program member for an embroidering machine which includes a plurality of data recording blocks containing control data for at least one of thread change, frame change and applying an applique cloths, the data recording blocks being arranged with non-recorded blocks interposed therebetween, and voice recording blocks having records based on the control data.

3 Claims, 2 Drawing Figures

MAGNETIC RECORDING MEMBER FOR AUTOMATIC EMBROIDERING MACHINE

The present invention relates to embroidery machines and more particularly to progragm operated automatic embroidery machines in which operations of the machines are controlled in accordance with the programmed memories. More specifically, the present invention pertains to a magnetic recording member storing such memories.

In recent developments in embroidery machines, there has been proposed a program operated automatic embroidery machine which utilizes a magnetic recording member such as a magnetic tape, stores on data for controlling the performance of embroidering operations. The data stored on the magnetic tape is picked up in the form of electrical signals which are applied through a signal converting circuit to an operating circuit. The operating circuit produces outputs for driving a sewing motor and cloth transferring servomotors to perform embroidering operations. The memories may further include control data for performing change of threads or embroidery frames or for the placement of pattern cloths for applique.

The present invention has an object to provide a magnetically recorded program member for an embroidering machine by which audio or other indications can be made generated to show that control data for thread change, for frame change and for putting applique cloth has been read from the program member.

Another object of the present invention is to provide a magnetically recorded program member for an embroidering machine which contains voice recording blocks for indicating existence of control data for thread changes, frame changes and for putting applique cloths.

According to the present invention, the above and other objects can be accomplished by a magnetically recorded program member for an embroidering machine which includes a plurality of data recording blocks containing control data for at least one of thread change, frame change and applying an applique cloths, the data recording blocks being arranged with non-recorded blocks interposed therebetween, and voice recording blocks having records based on the control data.

Figure 1:
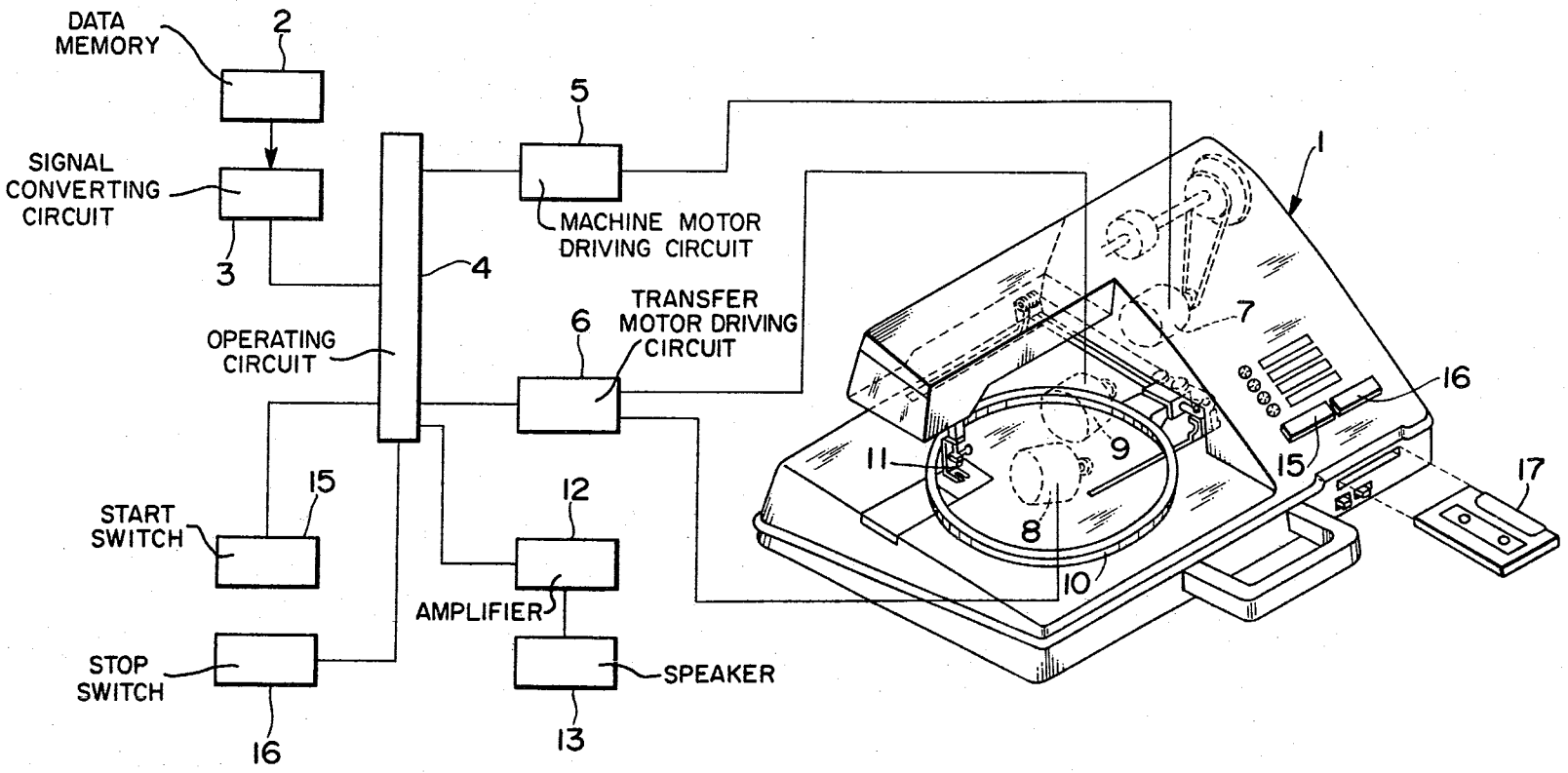
Figure 2:
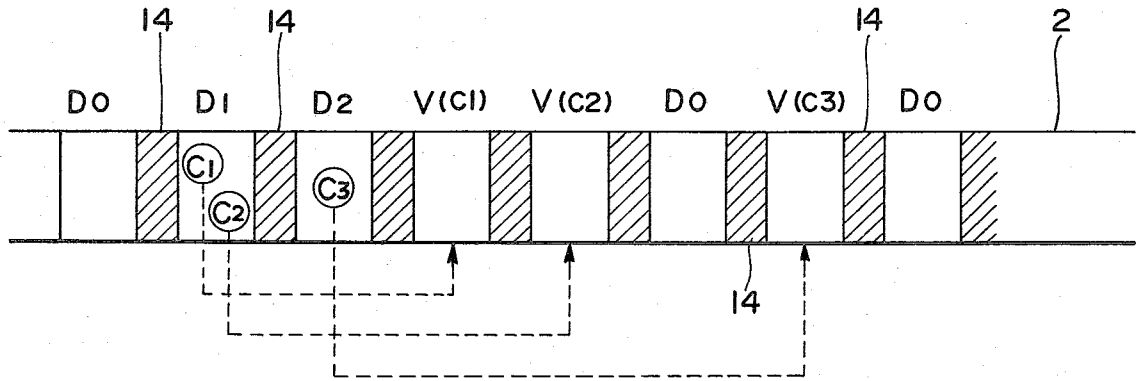

The above and other objects and features of the present invention will become apparent from the following descriptions of a preferred embodiment taking reference to the accompanying drawings, in which:

FIG. 1 is a block diagram showing the control circuit for the embroidering machine in which the program member in accordance with the present invention can be used; and, FIG. 2 shows an example of the recording tape in accordance with the present invention.

Referring now to the drawings, particularly to FIG. 1, there is shown an embroidering machine 1 which is designed to use a program data memory contained in a tape cassette 17. The embroidering machine 1 is in the form of a sewing machine having a sewing motor 7 for driving a sewing needle 11, a transverse transfer motor 8 and a longitudinal transfer motor 9. An embroidering frame 10 having a cloth stretched threrein is mounted on the machine 1 and the position of the frame 10 is controlled by the transfer motors 8 and 9.

In order to control the operations of the motors 7, 8 and 9, the tape in the cassette 17 contains embroidering data memory 2. The signal from the memory 2 is applied to a signal converting circuit 3 which produces an output signal and applies it to an operating circuit 4. The operating circuit 4 produces outputs in accordance with the data read from the data memory 2 for a machine motor driving circuit 5 and a transfer motor driving circuit 6. The circuit 5 produces an output for operating the machine motor 7 whereas the circuit 6 produces outputs for operating the transfer motors 8 and 9. The machine 1 is provided with a start switch 15 and a stop switch 16 which are associated with the operating circuit 4. The operating circuit 4 further has an output which is connected through an amplifier 12 with a speaker 13. The general structure and function of the program operated embroidering machine are well known in the art so that detailed descriptions will not be made.

Referring to FIG. 2, there is shown a magnetic tape 2 having a plurality of data blocks $D_0$, $D_1$ and $D_2$ which are separated by non-voice blocks 14. In the illustrated example, the data blocks $D_0$ contain data for controlling embroidering operations whereas the data blocks $D_1$ and $D_2$ contain control data $C_1$, $C_2$ and $C_3$ for thread change, frame change and applique cloth application, respectively. Further, the tape 2 includes voice recording blocks $V(C_1)$, $V(C_2)$ and $V(C_3)$ which are also separated by non-voice blocks 14 and respectively correspond to the control data $C_1$, $C_2$ and $C_3$, respectively. The voice recording blocks are provided immediately after the data block containing corresponding control data.

When the tape 2 as described above is used with the embroidering machine 1 which has been described previously, the embroidering operation is performed in accordance with the signals which are applied from the tape 2. Whenever the operation circuit 4 detects either of the control data $C_1$, $C_2$ and $C_3$ for thread change, frame change and applique cloth application, the corresponding voice recording block $V(C_1)$, $V(C_2)$ or $V(C_3)$ applies signals to the operation circuit 4 so that the operation circuit produces an output which is applied to the amplifier 12. Thus, a voice indication is given by the speaker 13 to the effect that the thread change, frame change or applique cloth change should be made.

The invention has thus been shown and described with reference to a specific embodiment, however, it should be noted that the invention is in no way limited to the details of the illustrated arrangement, but changes and modifications may be made without departing from the scope of the appended claims.

We claim:

1. A magnetically-recorded program member for use with a program-operated, automatic embroidery machine having embroidery controlling circuitry and an audio speaker, the recorder program member comprising:

a plurality of control data recording blocks, each of said control data recording blocks including control data indicating at least one of a thread change, frame change, and applique cloth application; and a plurality of voice recording blocks, each of said voice recording blocks being associated with a different one of said control data recording blocks and including signals for actuating said speaker to generate an audio message identifying the control data stored in said associated control data recording block.

2. A magnetically-recorded program member according to claim 1 wherein the program member is a magnetic tape contained in a cassette and wherein said control data blocks and said voice recording blocks are recorded on said magnetic tape.

3. A magnetically-recorded program member according to claim 1 wherein each of said voice recording blocks is provided after said control data recording block associated therewith.

* * * * *